US005974612A

United States Patent [19]

Cathcart

[11] Patent Number: 5,974,612

[45] Date of Patent: Nov. 2, 1999

[54] GOLF CLUB HEAD CLEANING APPARATUS

[76] Inventor: James A. Cathcart, 6920 NW. Dawn La., Kansas City, Mo. 64151

[21] Appl. No.: 09/053,995

[22] Filed: Apr. 2, 1998

[51] Int. Cl.[6] ..... A46B 13/02; A46B 15/00

[52] U.S. Cl. ..... 15/4; 15/23; 15/93.1

[58] Field of Search ..... 15/4, 23, 28, 93.1, 15/97.1

[56] References Cited

U.S. PATENT DOCUMENTS

| | | | |
|---|---|---|---|
| 3,407,431 | 10/1968 | Melnik | 15/23 |
| 3,935,909 | 2/1976 | Mabuchi et al. | 15/23 |
| 4,084,287 | 4/1978 | Ingram et al. | 15/216.1 |
| 4,210,974 | 7/1980 | Stoltzman | 15/21.2 |
| 4,238,867 | 12/1980 | Ruggero et al. | 15/4 |
| 4,344,202 | 8/1982 | Hayat | 15/4 |
| 4,344,203 | 8/1982 | Gerrick | 15/21.2 |
| 4,473,917 | 10/1984 | Britton | 15/104.94 |
| 4,683,603 | 8/1987 | Purlia et al. | 15/104.94 |
| 4,845,796 | 7/1989 | Mosley | 15/23 |
| 5,049,413 | 9/1991 | Gibson | 427/140 |
| 5,235,716 | 8/1993 | Stella | 15/23 |
| 5,307,534 | 5/1994 | Miller | 15/4 |
| 5,370,471 | 12/1994 | Kageyama et al. | 15/429 |
| 5,400,455 | 3/1995 | Crossley | 15/21.2 |
| 5,524,311 | 6/1996 | Crossley | 15/21.2 |
| 5,555,586 | 9/1996 | Dorrich et al. | 15/21.2 |
| 5,572,761 | 11/1996 | Meyer | 15/21.2 |
| 5,638,567 | 6/1997 | Danyluk | 15/21.2 |
| 5,787,539 | 8/1998 | Nussbaum | 15/29 |

*Primary Examiner*—Mark Spisich
*Assistant Examiner*—Theresa T. Snider
*Attorney, Agent, or Firm*—Hovey, Williams, Timmons & Collins

[57] ABSTRACT

A portable golf club head cleaning apparatus, having a housing (22), power source (24), motors (26, 28), a switch (30), rotary cleaning utensils (36, 38), and caps (39, 41), is utilized to clean the grooves formed in golf club heads. The power source (24) and motors (26, 28) are held inside the housing (22), and the switch (30) selectively connects the power source (24) with the motors (26, 28), which operate to rotate the cleaning utensils (36, 38). The caps (39, 41) removably connect to the ends of the housing (22) to cover the cleaning utensils (36, 38).

13 Claims, 2 Drawing Sheets

GOLF CLUB HEAD CLEANING APPARATUS

BACKGROUND OF THE INVENTION

This invention relates to cleaning apparatuses and, more particularly, to portable cleaning apparatuses for cleaning the grooves formed in golf club heads.

The hitting face of every golf club head is typically fabricated with narrow grooves. Generally, these grooves operate to improve a golfer's accuracy. As a golfer progress through a golf course, the grooves in the golf clubs become filled with grass, dirt, mud, sand, and other debris thereby inhibiting the accuracy of the golf clubs.

To maintain the accuracy of the golf clubs, the golfer is frequently found standing behind the T-box or on the fairway removing debris from the golf club heads with a golf-T, golf towel, or some combination thereof. However, these devices are not designed to clean grooves in club heads, and thus, they are generally inconvenient and ineffective to satisfactorily clean the grooves. Further, to the extent these devices can clean the grooves, such cleaning requires an inordinate amount of time thereby slowing play.

To try and clean the grooves with a golf-T, the pointed end of the golf-T is pushed down into the grooves and forced along the length of the grooves. However, the grooves are narrow enough that the pointed end of the golf-T is unable to completely penetrate into the grooves, and using a golf-T in this manner frequently results in a broken golf-T, an injured hand, or both. Using a golf towel is also ineffective to clean the grooves because it is impossible to apply enough force to push the towel completely into the grooves. Further, using a golf towel in this manner usually soils it to the extent that it is nearly impossible to clean.

Cleaning apparatuses have been provided for other, non-analogous uses, but these apparatuses are generally too bulky and heavy. Because golf involves extensive walking and because golfers frequently carry their equipment, they are unwilling to carry bulky or heavy items onto the golf course.

Thus, providing an effective cleaning apparatus for cleaning the grooves in golf club heads is desirable to enhance a golfer's accuracy and enjoyment of the game. It is also desirable to have a cleaning apparatus which is compact and light weight to encourage its use, thereby enhancing a golfer's consistency and enjoyment of the game. Further, it is desirable to have an efficient and effective cleaning apparatus for cleaning the grooves in golf club heads to enhance and speed up play.

BRIEF SUMMARY OF THE INVENTION

There is, therefore, provided in the practice of the invention a novel cleaning apparatus, which is light weight and compact, for cleaning the grooves formed in the heads of golf clubs. The cleaning apparatus includes a housing holding a power source and a motor. A switch selectively and operatively connects the motor with the power source, and the motor operates to rotate a shaft and a rotary cleaning utensil attached to the shaft.

In a preferred embodiment, the housing comprises a cylindrical housing having opposite ends with the cleaning utensil located adjacent one of the ends. A cap removably connects to the housing to enclose the cleaning utensil when it is connected to the housing. The cap is preferably provided with a clip used to attach the housing to a support surface such as a jacket pocket.

Additionally, the apparatus preferably includes a second motor, second shaft, second rotary cleaning utensil, and a second cap to cover the second cleaning utensil. The first cleaning utensil is adapted to remove debris from grooves formed in irons while the second cleaning utensil is adapted to remove debris from grooves formed in woods. Preferably, the first cleaning utensil comprises a brass wheel, and the second cleaning utensil comprises a brush.

Accordingly, it is an object of the present invention to provide an improved golf club head cleaning apparatus for cleaning the grooves in golf club heads.

BRIEF DESCRIPTION OF THE DRAWINGS

These and other inventive features, advantages, and objects will appear from the following Detailed Description of The Preferred Embodiments when considered in connection with the accompanying drawings in which similar reference characters denote similar elements throughout the several views and wherein.

DETAILED DESCRIPTION OF THE PREFERRED EMBODIMENTS

Figure 1:
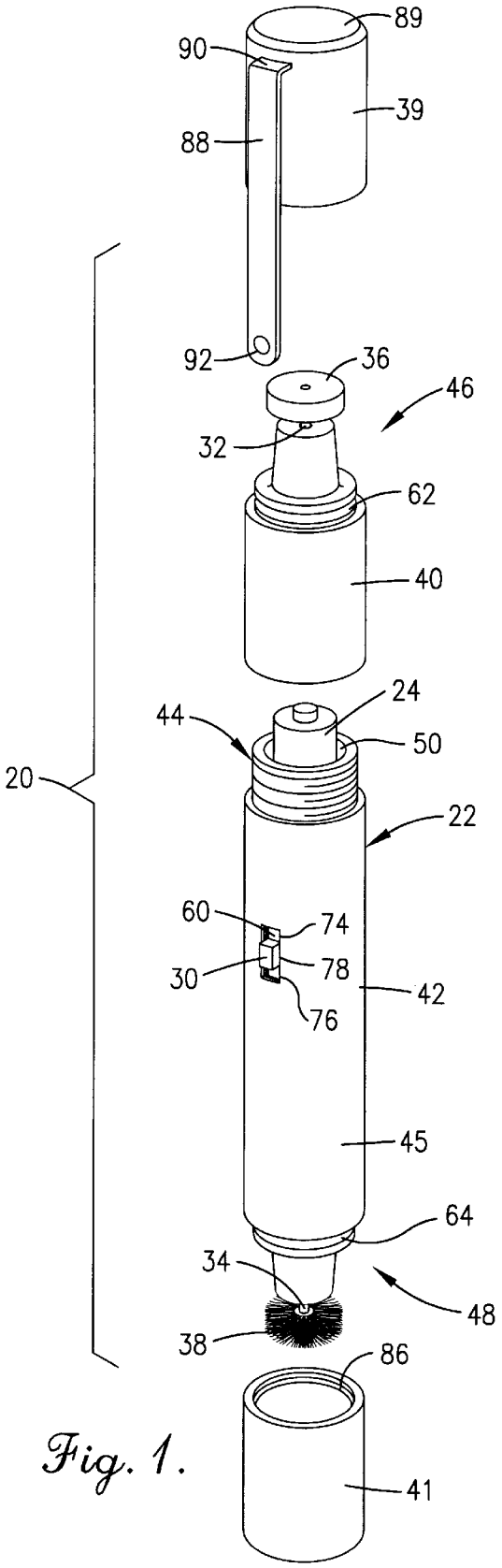
FIG. 1 is a partially exploded perspective view of a golf club head cleaning apparatus according to the present invention.
Figure 2:
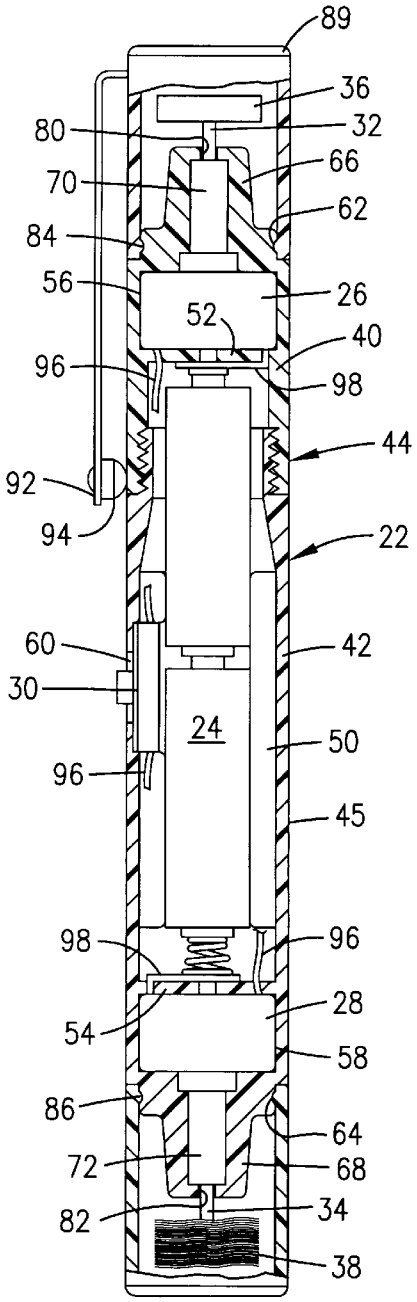
FIG. 2 is a longitudinal cross-sectional view of the golf club head cleaning apparatus of FIG. 1.
Figure 7:
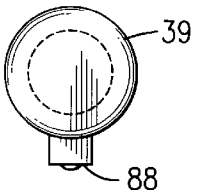
FIG. 7 is a top end, elevational view of the golf club head cleaning apparatus of FIG. 1.
Figure 8:
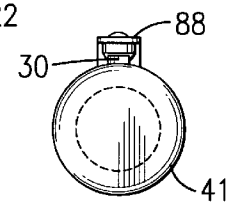
FIG. 8 is a bottom end, elevational view of the golf club head cleaning apparatus of FIG. 1.
Figure 6:
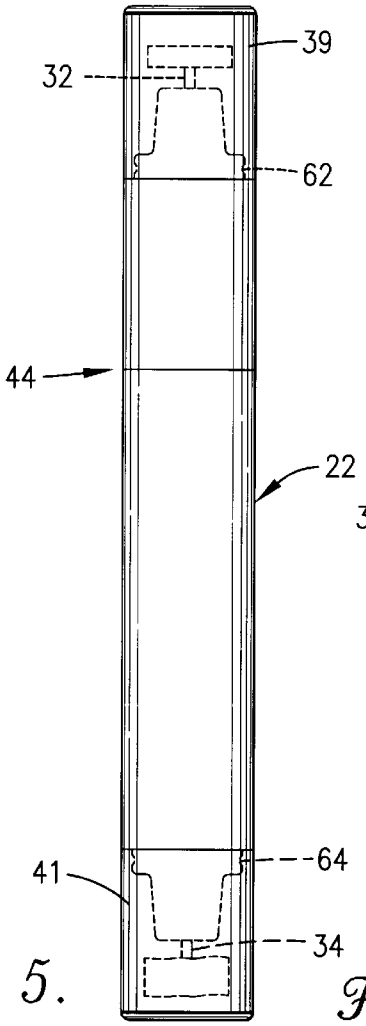
FIG. 6 is a rear, elevational view of the golf club head cleaning apparatus of FIG. 1.
Figure 5:
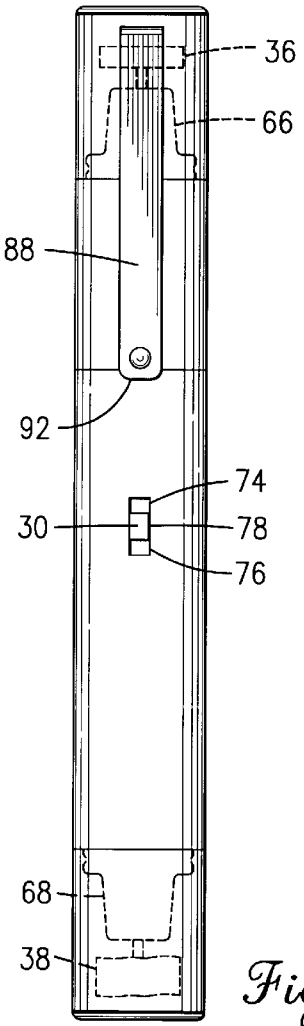
FIG. 5 is a front, elevational view of the golf club head cleaning apparatus of FIG. 1.
Figure 4:
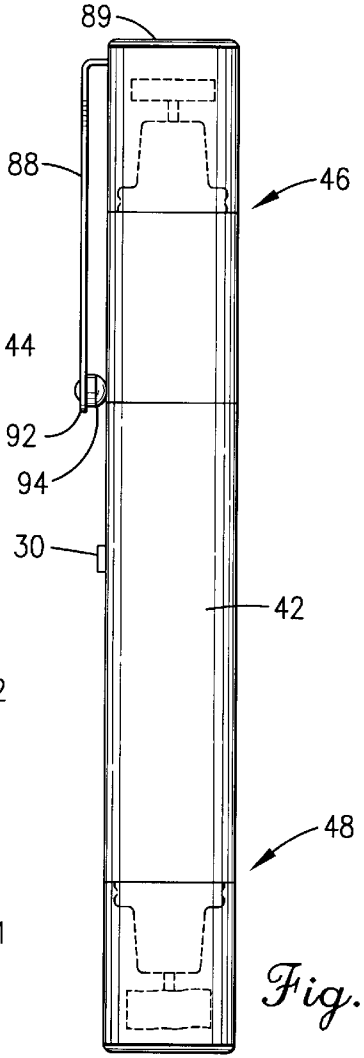
FIG. 4 is a side, elevational view of the golf club head cleaning apparatus of FIG. 1.
Figure 3:
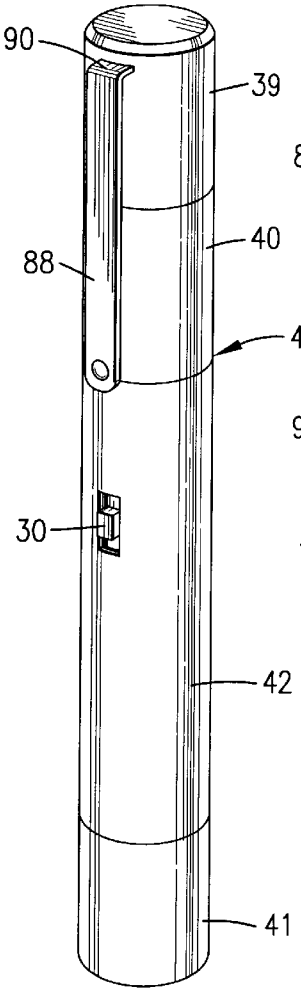
FIG. 3 is a perspective view of the golf club head cleaning apparatus of FIG. 1.

Referring to the drawings in greater detail, FIGS. 1 through 8 show a golf club head cleaning apparatus 20. Referring primarily to FIGS. 1 and 2, the cleaning apparatus 20 includes a housing 22, power source 24, motors 26, 28, a switch 30, rotary shafts 32, 34, iron and wood rotary cleaning utensils 36, 38, and caps 39, 41 for covering the cleaning utensils. The switch is operated to transmit power to the motors which impart rotation through the rotary shafts to the cleaning utensils to remove debris from grooves formed in the heads of golf clubs.

The housing 22 preferably comprises a substantially rigid, bifurcated housing having a first upper portion 40, a second lower portion 42, and a threaded connection 44 between the upper portion and the lower portion. The housing is generally cylindrical with a diameter less than approximately ½ inch, a smooth outer surface 45, and opposite ends 46, 48. In the preferred embodiment the housing has the ornamental configuration of a pen.

The housing defines a cylindrical, internal power source cavity 50 between the upper and lower portions of the housing. Flat and circular motor mounts 52, 54 are positioned adjacent to the opposite ends of the housing and define the ends of the power source cavity. Motor cavities 56, 58 are also defined inside the housing adjacent to the motor mounts and opposite the power source cavity. The housing further defines a rectangular switch aperture 60 positioned substantially centrally on the housing. The length of the switch aperture extends parallel to the length of the housing. External snap grooves 62, 64 are formed near the opposite ends 46, 48 respectively. Each end 46, 48 terminates with a rotary shaft mount 66, 68 which hold stabilizing bushings 70, 72 therein.

The upper end 46 comprises an iron end for cleaning the grooves formed in irons, and the lower end 48 comprises a wood end for cleaning the grooves formed in woods. Thus, the components at the iron end 46 are iron components, and the components at the wood end 48 are wood components.

The power source 24, which preferably comprises batteries, such as rechargeable batteries, is held inside the power source cavity 50. The batteries are preferably cylindrical to match the pen shaped configuration of the housing and are accessible for replacement or recharging by separating the upper and lower portions 40, 42 of the housing at the threaded connection 45.

The motors 26, 28 are mounted to the motor mounts 52, 54 inside of the motor cavities 56, 58. The iron motor 26 is adjacent the iron end 46 of the housing, and the wood motor 28 is adjacent the wood end 48 of the housing.

The switch 30, which extends through the switch aperture 60, is preferably a three position switch having an on position 74 for the iron utensil 36, an on position 76 for the wood utensil 38, and an off position 78 between the iron on position 74 and the wood on position 76. The switch positions are longitudinally arranged along the length of the housing with the iron on position 74 located nearer to the iron end 46 of the housing and to the iron cleaning utensil 36 than the wood end 48, and the wood on position 76 is located nearer to the wood end 48 of the housing and to the wood cleaning utensil 38 than the iron end 46. The switch 30 is electrically interposed between the motor and the power source to selectively and operatively connect the motor with the power source, so that an operator moves the switch to activate the desired cleaning utensil.

The rotary shafts 32, 34 are coupled with the motors for rotation by the motors and extend from the motors through the stabilizing bushings 70, 72 in directions parallel to the length of the housing. The rotary shafts extend out of the housing 22 through shaft openings 80, 82 located at the opposite ends of the housing. The shaft openings are sized to allow the shafts to rotate relative to the housing.

The rotary cleaning utensils 36, 38 are attached to the ends of the rotary shafts opposite the motors and rotate with the rotary shafts outside the housing. The first cleaning utensil 36 comprises an iron cleaning utensil which is preferably brass and configured and sized to extend into golf club head grooves. The preferred configuration is a cylindrical wheel having a height to fit within the grooves. The second cleaning utensil 38 comprises a wood cleaning utensil which is preferably a cylindrical brush with bristles soft enough not to damage the woods or deform the grooves. Thus, the iron cleaning utensil is of a different type than the wood cleaning utensil, and the wood cleaning utensil is softer than the iron utensil; so that the iron utensil is adopted to remove debris from grooves in irons, and the wood utensil is adapted to remove debris from grooves in woods.

The caps 39, 41 removably connect to the housing at its opposite ends and have snap ridges 84, 86 which mate with the snap grooves 62, 64 of the housing. The caps are generally cylindrical and have substantially the same diameter as the housing 22. Preferably, the iron cap 39 has the configuration of a pen cap with a clip 88 attached near its top 89. The clip has an attached end 90 which is fixably attached to the iron cap 39 and a movable end 92 adjacent and operatively associated with the outer surface of the housing for removably securing the cleaning apparatus to a support structure such as a jacket pocket, golf bag or score card. The clip extends parallel to the length of the housing and has a rounded protrusion 94 adjacent the movable end 92 for engaging the support structure.

In operation, a golfer removes the cap covering the desired cleaning utensil, and activates the desired cleaning utensil by pushing the externally accessible switch 30 in the direction of the desired cleaning utensil. With the switch in the iron on position 74, for example, power is transmitted through electrical wires 96 and contacts 98 to the iron motor 26 which imparts rotation to the iron cleaning utensil 36 through the iron rotary shaft 32. With the iron cleaning utensil rotating, the golfer brings the cleaning utensil into contact with the grooves in the iron to remove debris. When the debris has been removed, the golfer returns the switch to the off position 78, places the iron cap 39 over the iron cleaning utensil 36 and returns the apparatus to its storage location.

The golf club head cleaning apparatus 20 according to the present invention, provides a lightweight and compact device which is effective for cleaning the grooves formed in the golf club heads of both irons and woods. Because of its size, weight, and covered cleaning utensils, the cleaning apparatus is convenient to carry and can be stored in many locations including jacket and shirt pockets without damaging the clothing material.

Thus, a compact and lightweight golf club head cleaning apparatus is disclosed which utilizes a rotating cleaning utensil to clean the grooves in golf club heads thereby enhancing play. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A portable golf club head cleaning apparatus for cleaning grooves formed in golf club heads, the cleaning apparatus comprising:

a substantially rigid housing;

a power source held by the housing;

a motor mounted to the housing, and the motor being selectively and operatively connected with the power source to receive power from the power source;

a switch selectively and operatively connecting the motor with the power source;

a rotary shaft extending from the motor for rotation relative to the housing;

a rotary cleaning utensil located outside the housing, and the utensil being connected to the rotary shaft for rotation with the rotary shaft;

a second motor mounted to the housing, and the second motor being selectively and operatively connected with the power source to receive power from the power source;

a second rotary shaft extending from the second motor for rotation relative to the housing; and a second rotary cleaning utensil located outside the housing, and the second utensil being connected to the second rotary shaft for rotation with the second rotary shaft.

2. The cleaning apparatus according to claim 1 wherein the housing comprises an elongated, generally cylindrical housing having opposite ends with the cleaning utensil adjacent to one of the opposite ends; and the housing defines an internal power source cavity having the power source held therein and an internal motor cavity having the motor mounted therein.

3. The cleaning apparatus according to claim 2 wherein the housing comprises a diameter less than approximately ½ inch, and a motor mount mounting the motor within the housing.

4. The cleaning apparatus according to claim 1 wherein the housing comprises a bifurcated housing defining an internal power source cavity having the power source held therein, and the bifurcated housing including a first portion, a second portion, a threaded connection between the first portion and the second portion to separate the first portion from the second portion for access to the internal power source cavity.

5. The cleaning apparatus according to claim 1 further comprising a clip operatively associated with the housing to clip the housing onto a support surface.

6. The cleaning apparatus according to claim 1 wherein the switch comprises a three position switch, the first utensil comprises a brush, and the second utensil comprises a brass wheel.

7. The cleaning apparatus according to claim 1 further comprising a first cap removably connected to the housing and enclosing the first cleaning utensil when connected to the housing, and a second cap removably connected to the housing opposite the first cap and enclosing the second cleaning utensil when connected to the housing.

8. A portable cleaning apparatus for removing debris from grooves formed in golf club heads of both irons and woods, the cleaning apparatus comprising:

a substantially rigid housing having a cylindrical outer surface, an iron end, a wood end opposite the iron end, an iron motor mount adjacent the iron end, and a wood motor mount adjacent the wood end;

a power source held by the housing between the iron motor mount and the wood motor mount;

an iron motor mounted to the iron motor mount, and the iron motor being selectively and operatively connected with the power source to receive power from the power source;

a wood motor mounted to the wood motor mount, and the wood motor being selectively and operatively connected with the power source to receive power from the power source a switch selectively and operatively connecting the iron motor and the wood motor with the power source;

an iron rotary shaft coupled with the iron motor for rotation by the iron motor, and the iron shaft extending from the iron end of the housing for rotation relative to the housing;

a wood rotary shaft coupled with the wood motor for rotation by the wood motor, and the wood shaft extending from the wood end of the housing for rotation relative to the housing;

an iron cleaning utensil located outside the housing, and the iron cleaning utensil being connected to the iron rotary shaft opposite the iron motor for rotation with the iron rotary shaft; and a wood cleaning utensil located outside the housing, and the wood cleaning utensil being connected to the wood shaft opposite the wood motor for rotation with the wood rotary shaft.

9. The cleaning apparatus according to claim 8 further comprising an iron cap removably connected to the iron end of the housing and enclosing the iron cleaning utensil when connected to the housing, and a wood cap removably connected to the wood end of the housing and enclosing the wood cleaning utensil when connected to the housing.

10. The cleaning apparatus according to claim 8 wherein the iron cleaning utensil comprises a brass wheel, and the wood cleaning utensil comprises a brush.

11. The cleaning apparatus according to claim 8 wherein the switch comprises a three position switch having an iron on position, a wood on position opposite the iron on position, and an off position between the iron on position and the wood on position.

12. The cleaning apparatus according to claim 11 wherein the iron on, wood on, and off positions are longitudinally aligned with a length of the housing, the iron on position is located nearer the iron cleaning utensil than the wood cleaning utensil, and the wood on position is located nearer the wood cleaning utensil than the iron cleaning utensil.

13. The cleaning apparatus according to claim 8 wherein the iron cleaning utensil comprises a cylindrical wheel having a height less than a width of the grooves formed in the golf club heads.

* * * * *